US007923910B2

(12) United States Patent
Nakamura et al.

(10) Patent No.: US 7,923,910 B2
(45) Date of Patent: Apr. 12, 2011

(54) SPARK PLUG HAVING A METALLIC SHELL WITH DEFINED RELATIONSHIP BETWEEN ITS OUTER AND INNER SURFACES

(75) Inventors: Mai Nakamura, Inazawa (JP); Akira Suzuki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/631,301

(22) Filed: Dec. 4, 2009

(65) Prior Publication Data

US 2010/0141110 A1 Jun. 10, 2010

(30) Foreign Application Priority Data

Dec. 5, 2008 (JP) ..... 2008-310544

(51) Int. Cl.
*H01T 13/00* (2006.01)
*H01T 13/02* (2006.01)

(52) U.S. Cl. ..... 313/143; 313/144

(58) Field of Classification Search ..... 313/118–145; 123/169 EL

See application file for complete search history.

(56) References Cited

U.S. PATENT DOCUMENTS

| | | | | |
|---|---|---|---|---|
| 6,373,173 | B1 * | 4/2002 | Suzuki | 313/143 |
| 2008/0061670 | A1 | 3/2008 | Nakayama et al. | |
| 2009/0102345 | A1 | 4/2009 | Hotta et al. | |

FOREIGN PATENT DOCUMENTS

| | | | |
|---|---|---|---|
| EP | 404570 | A2 * | 12/1990 |
| EP | 1022828 | A2 * | 7/2000 |
| JP | 06333664 | A * | 12/1994 |
| JP | 2002260817 | A * | 9/2002 |
| JP | 2007-059077 | A | 3/2007 |
| JP | 2008-091322 | A | 4/2008 |

* cited by examiner

*Primary Examiner* — Mariceli Santiago
(74) *Attorney, Agent, or Firm* — Sughrue Mion, PLLC

(57) ABSTRACT

A spark plug including an insulator and a metallic shell having an outer surface and an inner surface. The outer surface has a taper portion which comes into contact with a peripheral region around a mounting hole of an internal combustion engine, a tool engagement portion, and a trunk portion formed between the tool engagement portion and the taper portion. The inner surface has an annular step portion projecting toward the insulator and an internal trunk portion extending from the base of the step portion toward the rear end of the metallic shell. When the insulator and the metallic shell are fixed to each other by one of either cold and hot crimping, the projected area of the taper portion is at least two times or at least 1.5 times that of the step portion, respectively.

10 Claims, 5 Drawing Sheets

SPARK PLUG HAVING A METALLIC SHELL WITH DEFINED RELATIONSHIP BETWEEN ITS OUTER AND INNER SURFACES

BACKGROUND OF THE INVENTION

1. Field of the Invention

The present invention relates to a spark plug, and more particularly to a spark plug for use, for example, in an internal combustion engine.

2. Description of the Related Art

A spark plug used in an internal combustion engine, such as an automobile engine, generally includes a center electrode; an insulator which holds the center electrode; a metallic shell which holds the insulator; and a ground electrode whose one end is joined to a front end portion of the metallic shell and whose other end faces an end portion of the center electrode so as to form a spark discharge gap therebetween. The metallic shell has a mounting threaded portion at its outer circumference, for attachment to an engine or the like.

A front end portion of the insulator is inserted into the metallic shell of the spark plug from the rear end of the metallic shell toward the front end of the metallic shell. Subsequently, a rear end opening portion of the metallic shell is crimped so as to fix the metallic shell to the insulator. A packing is interposed between a step portion provided on the outer surface of the insulator and a step portion provided on the inner surface of the metallic shell, and an annular space between an outer surface of the insulator and an inner surface of the metallic shell is filled with a powder composed mainly of talc, thereby preventing gas leakage from a combustion chamber of the internal combustion engine.

3. Problems to be Solved by the Invention

In order to prevent gas leakage from a combustion chamber of an internal combustion chamber, when the metallic shell is to be crimped to the insulator, a sufficient crimping load must be imposed for ensuring gas-tightness of the junction between the metallic shell and the insulator. However, a large crimping load is not absolutely acceptable. Namely, an excessively large crimping load deforms a trunk portion of the outer surface of the metallic shell in a region contacting a crimping die. In the case of a spark plug in which a portion of the metallic shell contacting the crimping die assumes the form of an annular plane, and a gasket is disposed on the annular plane portion for ensuring gas-tightness at a peripheral region of an opening of a mounting hole of an internal combustion engine, the deformation rate in relation to the crimping load is low. Thus, the above problem does not arise often. However, when a portion of the metallic shell contacting the crimping die assumes a taper form, an excessive crimping load may deform the taper portion of the metallic shell.

Recently, in association with improved engine control technology and an increase in the number of valves, an increasing number of components are disposed around the engine. Accordingly, a volume allocated for a spark plug is decreasing, so that a reduction in spark plug size is eagerly desired.

A reduction in spark plug size is accompanied by a reduction in the area of the packing provided for preventing gas leakage from a combustion chamber of an internal combustion engine and a reduction in the volume of the annular space into which talc is filled. Thus, in order to ensure gas-tightness, the crimping load must be increased. Meanwhile, since a reduction in the size of a spark plug is accompanied by a reduction in the size of the metallic shell, imposition of a large crimping load makes the taper portion of the metallic shell more susceptible to deformation.

SUMMARY OF THE INVENTION

An object of the present invention is to provide a spark plug having a metallic shell, the metallic shell having an outer surface including a taper portion which comes into contact with a peripheral region around a mounting hole of an internal combustion engine, and which taper portion is not deformed when the spark plug is mounted in the engine so as to provide excellent gas-tightness.

The above object has been achieved by providing, in a first aspect (1) of the invention, a spark plug comprising a rodlike center electrode extending in an axial direction; an insulator which holds an outer circumference of the center electrode; a metallic shell which holds an outer circumference of the insulator; and a ground electrode joined to a front end portion of the metallic shell and forming a spark gap in cooperation with the center electrode; wherein the metallic shell has an outer surface having: a taper portion which comes into contact with a peripheral region around a mounting hole of an internal combustion engine when the spark plug is inserted in the mounting hole; a tool engagement portion with which a tool is engaged when mounting the spark plug into the mounting hole; and a trunk portion formed between the tool engagement portion and the taper portion, and an inner surface having: an annular step portion projecting toward the insulator and an internal trunk portion extending from a base of the step portion toward a rear end of the metallic shell, wherein an outside diameter of the trunk portion is represented by B, a minimal outside diameter of the taper portion is represented by C, an inside diameter of the internal trunk portion is represented by D, and an inside diameter of the step portion is represented by E, the insulator and the metallic shell are fixed to each other by cold crimping, and a projected area ($\pi(B/2)^2-\pi(C/2)^2$) of the taper portion, defined as a difference between an area of a region surrounded by an outline of the trunk portion projected on an imaginary plane orthogonal to the axis and an area of a region surrounded by an outline of the taper portion at its minimal outside diameter projected on the imaginary plane, is at least two times a projected area ($\pi(D/2)^2-\pi(E/2)^2$) of the step portion defined as a difference between an area of a region surrounded by an outline of the internal trunk portion projected on the imaginary plane and an area of a region surrounded by an outline of the step portion projected on the imaginary plane.

In a second aspect (2), the present invention provides a spark plug comprising a rodlike center electrode extending in an axial direction; an insulator which holds an outer circumference of the center electrode; a metallic shell which holds an outer circumference of the insulator; and a ground electrode joined to a front end portion of the metallic shell and forming a spark gap in cooperation with the center electrode; wherein the metallic shell has an outer surface having: a taper portion which comes into contact with a peripheral region around a mounting hole of an internal combustion engine when the spark plug is inserted in the mounting hole; a tool engagement portion with which a tool is engaged when mounting the spark plug into the mounting hole; and a trunk portion formed between the tool engagement portion and the taper portion, and an inner surface having: an annular step portion projecting toward the insulator and an internal trunk portion extending from a base of the step portion toward a rear end of the metallic shell, wherein an outside diameter of the trunk portion is represented by B, a minimal outside diameter of the taper portion is represented by C, an inside diameter of the internal trunk portion is represented by D, and an inside diameter of the step portion is represented by E, the insulator and the metallic shell are fixed to each other by hot crimping, and a projected area ($\pi(B/2)^2-\pi(C/2)^2$) of the taper portion, defined as a difference between an area of a region surrounded by an outline of the trunk portion projected on an imaginary plane orthogonal to the axis and an area of a region surrounded by an outline of the taper portion at its minimal outside diameter projected on the imaginary plane, is at least 1.5 times a projected area ($\pi(D/2)^2\pi(E/2)^2$) of the step portion defined as a difference between an area of a region surrounded by an outline of the internal trunk portion projected on the imaginary plane and an area of a region surrounded by an outline of the step portion projected on the imaginary plane.

In a preferred embodiment (3) according to (1) or (2) above, the outer surface of the metallic shell has a threaded portion for mounting the spark plug into the mounting hole of the internal combustion engine, the threaded portion having an outside diameter of 12 mm or less.

In another preferred embodiment (4) according to any one of (1) to (3) above, the projected area of the step portion is 6 $mm^2$ to 18 $mm^2$ inclusive.

In yet another preferred embodiment (5) according to any of (1) to (4), the taper portion has a taper angle θ of 50° to 120° inclusive, In yet another preferred embodiment (6) according to any of (1) to (5) above, the spark plug further comprises a seal filler including talc provided between the inner surface of the metallic shell opposite the tool engagement portion and an outer surface of the insulator.

EFFECT OF THE INVENTION

In the spark plug according to the present invention, when metallic shell is crimped to fix the metallic shell and the insulator to each other by cold crimping, the projected area of the taper portion is at least two times the projected area of the step portion, and, when the metallic shell is crimped to fix the metallic shell and the insulator to each other by hot crimping, the projected area of the taper portion is at least 1.5 times the projected area of the step portion. Thus, the taper portion is not deformed when the spark plug is mounted into the mounting hole of the engine so as to provide excellent gas-tightness.

Particularly, even in a small-sized spark plug in which the threaded portion to be screwed into a mounting hole of an internal combustion engine has an outside diameter of 12 mm or less, the taper portion is not deformed so as to provide excellent gas-tightness.

The above-described effect of the invention is obtained to yet a greater extent when: the projected area of the step portion is 6 $mm^2$ to 18 $mm^2$ inclusive; the taper angle θ of the taper portion is 50° to 120° inclusive; and talc is provided between the inner surface of the metallic shell opposite the tool engagement portion and the outer surface of the insulator.

DESCRIPTION OF REFERENCE NUMERALS

Figure 1:
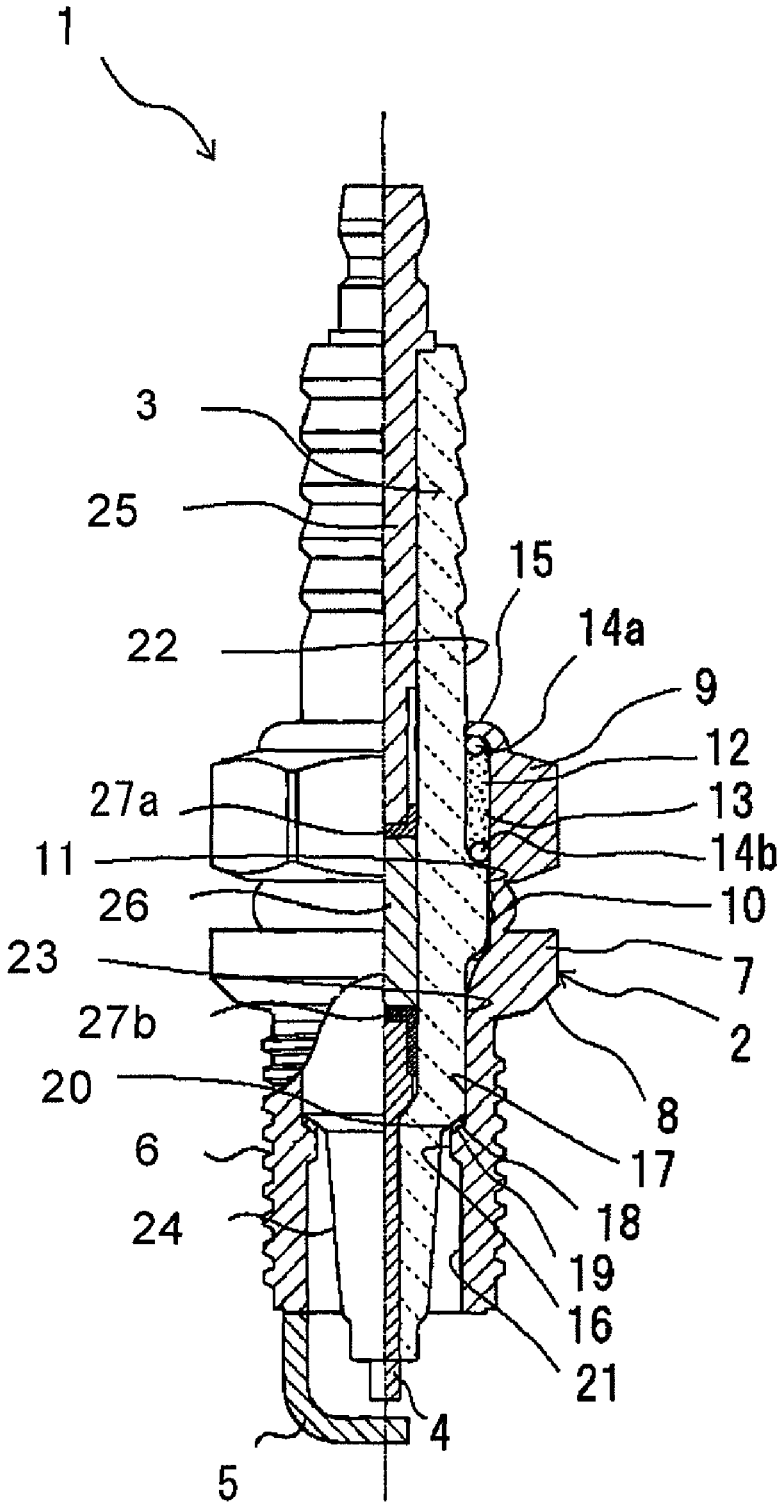
FIG. 1 is a partially sectional, general, explanatory view of a spark plug which is one embodiment of the spark plug according to the present embodiment.

Reference numerals used to identify various structural features in the drawings include the following.

1: spark plug
2: metallic shell
3: insulator
4: center electrode
5: ground electrode
6: threaded portion
7: trunk portion
8: taper portion
9: tool engagement portion
10: curvature portion
11: projecting insulation portion
12: annular space
13: seal filler
14*a*, 14*b*: seal member
15: crimp portion
16: step portion
17: internal trunk portion
18: shoulder
19: packing member
20: stepped portion

DETAILED DESCRIPTION OF THE PREFERRED EMBODIMENTS

The invention is described in detail below by reference to the drawings. However, the present invention should not be construed as being limited thereto.

An embodiment of the spark plug according to the present invention is shown in FIG. 1. FIG. 1 is a partially sectional, general explanatory view of the spark plug of the present embodiment. In the following description, a direction toward the bottom of the paper on which FIG. 1 appears corresponds to the front end direction of the spark plug, and a direction toward the top of the paper corresponds to the rear end direction. In the drawings described below, like components or structural features are denoted by like reference numerals. As shown in FIG. 1, the spark plug 1 includes a substantially cylindrical metallic shell 2; a substantially cylindrical insulator 3 which is inserted through the metallic shell 2 so that its front end portion projects from the metallic shell 2; a substantially rodlike center electrode 4 provided along the center axis of the insulator 3 so as to project from the front end portion of the insulator 3; and a ground electrode 5 whose one end is attached to a front end portion of the metallic shell 2 and whose other end faces the center electrode 4 with a spark gap defined therebetween.

Preferably, the metallic shell 2 is formed from an electrically conductive steel material, such as low-carbon steel.

The metallic shell 2 assumes a substantially cylindrical shape and holds the outer circumference of the insulator 3 inserted therein. The metallic shell 2 has a threaded portion 6 formed on the outer surface of a portion extending toward its front end. By utilizing the threaded portion 6, the metallic shell 2 is mounted (screwed) into a mounting hole formed in a cylinder head of an unillustrated internal combustion engine. The metallic shell 2 has a flange-like trunk portion 7 located rearward of the rear end of the threaded portion 6. A taper portion 8 connects the trunk portion 7 and the rear end of the threaded portion 6 and assumes the form of a conical taper. When the spark plug 1 is mounted into the mounting hole of the internal combustion engine, the taper portion 8 and a peripheral region around the mounting hole of the internal combustion engine come in contact with each other, to thereby retain gas-tightness. The metallic shell 2 has a tool engagement portion 9 which is located rearward of the trunk portion 7. A tool, such as a spanner or a wrench, is used to engage the tool engagement portion when the spark plug 1 is mounted into the mounting hole of the internal combustion engine. The tool engagement portion 9 has a hexagonal cross section. In the present embodiment, the perimeter of the tool engagement portion 9 assumes the form of a hexagon (HEX). However, the perimeter of the tool engagement portion 9 may assume the form of an icositetragon (Bi-HEX). A curvature portion 10 connects the tool engagement portion 9 and the trunk portion 7, and is curved outward in a radial direction orthogonal to the axis of the metallic shell 2.

An annular space 12, formed between the outer surface of the insulator 3 and the inner surface of the tool engagement portion 9 of the metallic shell 2, is filled with a seal filler 13, such as an inorganic powder composed mainly of talc. Ring-like seal members 14*a* and 14*b* are provided at axially opposite ends of the annular space 12. A peripheral edge part of a rear end portion of the metallic shell 2 is crimped axially frontward. As a result, the rear end portion is curved inward, thereby forming a crimp portion 15 so as to fix the metallic shell 2 to the insulator 3. At this time, the seal filler 13 and the seal members 14*a* and 14*b* enhance the degree to which the metallic shell 2 and the insulator 3 are mutually fixed.

The inner surface of the metallic shell 2 has an annular step portion 16 projecting toward the insulator 3 and an internal trunk portion 17 extending from the base of the step portion 16 toward the inside; i.e., axially rearward. A shoulder 18 of the step portion 16 rises from the internal trunk portion 17 toward the insulator 3 and may assume the form of a taper which reduces in diameter in the frontward direction. The shoulder 18 engages the stepped portion 20 of the insulator 3 via a sheet-like packing member 19, thereby fixing the insulator 3 and the metallic shell 2 to each other in the axial direction and thus ensuring gas-tightness of the junction between the insulator 3 and the metallic shell 2. A front portion 21 extends axially frontward from the step portion 16 and is located away from the outer surface of the insulator 3 with a predetermined gap therebetween. In the embodiment shown in FIG. 1, the step portion 16 of the metallic shell 2 projects inward with respect to the inner surfaces of the internal trunk portion 17 and the front portion 21. However, no particular limitation is imposed thereon, so long as the shoulder 18 is formed on the inner surface of the metallic shell 2. Without forming a step between the step portion 16 and the front portion 21, the inner surface of the metallic shell 2 may make a smooth transition from the step portion 16 to the front portion 21.

The insulator 3 is formed from a ceramic sintered body or the like composed mainly of alumina.

The insulator 3 has a substantially cylindrical shape. The outer surface of the insulator 3 has, from the axially rear side, a rear insulation portion 22 having a portion whose outer circumference is not held by the metallic shell 2, and a portion defining a side of the annular space 12; a projecting insulation portion 11 which projects outward in the form of a flange and faces the inner surface of the tool engagement portion 9 of the metallic shell 2 and/or the inner surface of the curvature portion 10; an interior trunk insulation portion 23 which faces the interior trunk portion 17 of the metallic shell 2; a stepped portion 20 which engages the shoulder 18 of the metallic shell 2; and a front insulation portion 24 which is located away from the front portion 21 of the metallic shell 2 with a predetermined gap therebetween. As described above, the insulator 3 is fixed to the inside of the metallic shell 2 via the seal filler 13, the seal members 14*a* and 14*b*, and a packing member 19. The insulator 3 has a through hole extending along the center axis; a center electrode 4 is held in the through hole on the axially front side; and a terminal metal 25 is held in the through hole on the axially rear side. A resistor 26 is disposed within the through hole between the center electrode 4 and the terminal metal 25. Opposite end portions of the resistor 26 are electrically connected to the terminal metal 25 and the center electrode 4 via electrically conductive glass seal layers 27*a* and 27*b*, respectively.

The center electrode 4 is composed of an external material and an internal material, which is concentrically embedded in an axial portion of the external material (not shown). Preferably, the external material is a metallic material having excellent heat resistance and corrosion resistance, such as an Ni alloy. Preferably, the internal material is a metallic material having excellent thermal conductivity, such as copper (Cu) or silver (Ag). The center electrode 4 is a circular columnar body and is fixed in an axial hole of the insulator 3 in such manner that its front end projects from the front end surface of the insulator 3, thereby being held in place while being electrically insulated from the metallic shell 2. A circular columnar noble metal chip of Pt, a Pt alloy, Ir, an Ir alloy, or the like may be fused to the front end surface of the external material.

Preferably, the ground electrode 5 is formed from an Ni-based alloy or the like having excellent heat resistance and corrosion resistance. The ground electrode 5 assumes the form of, for example, a rectangular columnar body. The ground electrode 5 is designed in shape and structure as follows: one end of the ground electrode 5 is joined to the front end surface of the metallic shell 2; the ground electrode 5 is bent at an intermediate position to a shape resembling the letter L; and a distal end portion of the ground electrode 5 is located in the axial direction of the center electrode 4. Through such design of the ground electrode 5, one end of the ground electrode 5 is disposed so as to face the center electrode 4 with a spark gap defined therebetween. A circular columnar noble metal chip of Pt, a Pt alloy, Ir, an Ir alloy, or the like may be fused to a surface of the ground electrode 5 which faces the center electrode 4.

No particular limitation is imposed on the outside diameter of the threaded portion 6 of the spark plug 1 according to the present invention. However, the effect of the present invention is particularly remarkable in the case of a small-sized spark plug whose threaded portion 6 has an outside diameter of 12 mm or less; i.e., a nominal size of M12 or smaller as specified in JIS B 8031 (2005). The reason is as follows: As the size of the spark plug 1 is reduced, the area of the shoulder 18 of the metallic shell 2 is reduced. Accordingly, in order to ensure gas-tightness, the crimping load must unavoidably be increased, and increasing the crimping load is apt to deform the taper portion 8 of the metallic shell 2. According to the present invention, even in the case of a small-sized spark plug 1 whose threaded portion 6 has an outside diameter of 12 mm or less, the taper portion 8 is not deformed. Consequently, the present invention can provide the spark plug 1 having excellent gas-tightness.

The range of the ratio between the projected area of the taper portion 8 and the projected area of the step portion 16 for achieving the object of the present invention differs depending on whether the metallic shell 2 and the insulator 3 are fixedly crimped to each other by cold crimping or by hot crimping.

First, cold crimping and hot crimping will be described.

Figure 2:
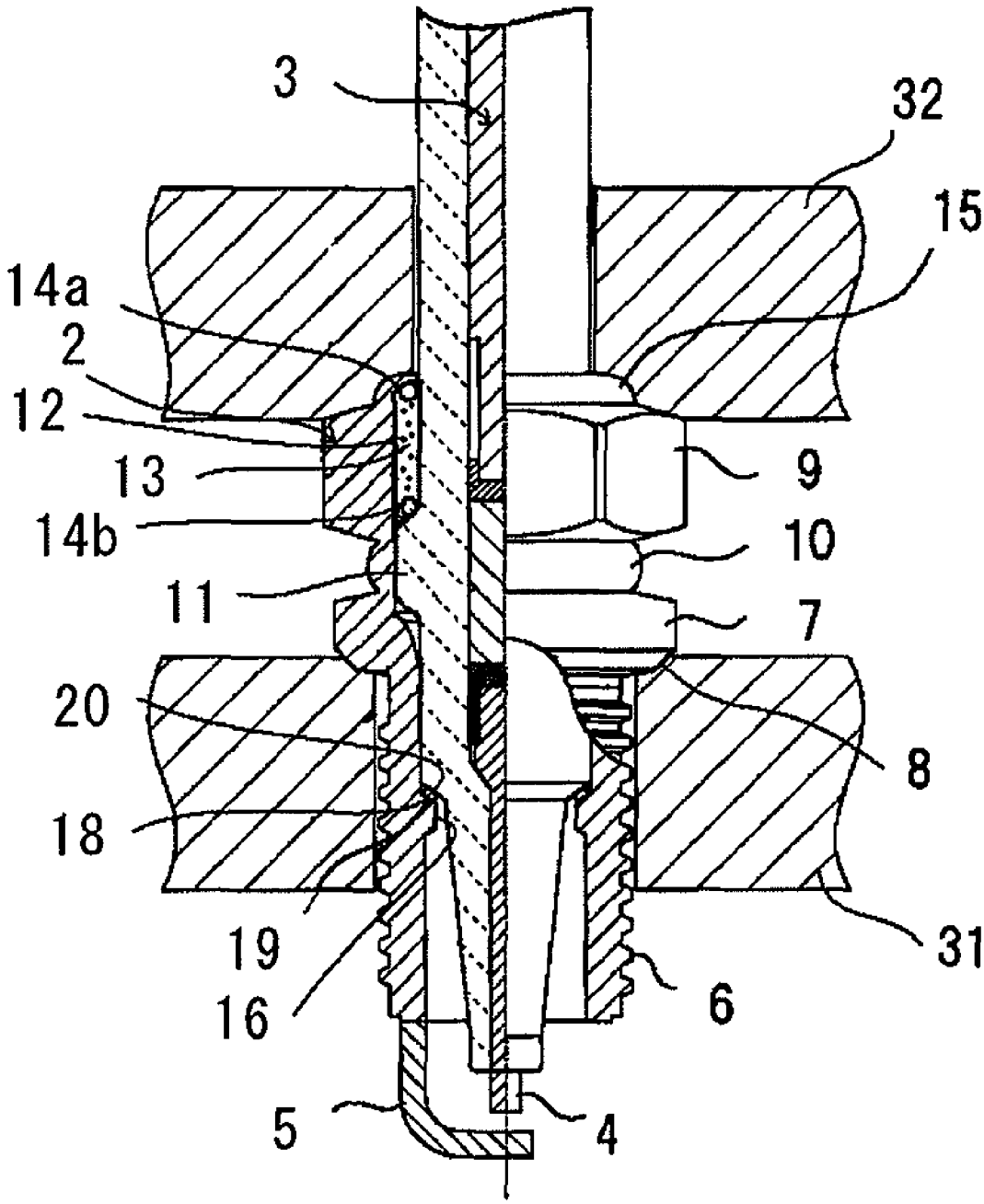
FIG. 2 is a schematic, sectional, explanatory view showing an example process of cold crimping as applied to the spark plug according to the present invention.

FIG. 2 is a schematic, sectional, explanatory view showing an example process of cold crimping as applied to the spark plug according to the present invention. Cold crimping is carried out at room temperature as follows. A lower die 31 is brought into contact with the lower side of the trunk portion 7 of the metallic shell 2, i.e., the taper portion 8; an upper die 32 is brought into contact with the upper end surfaces of a crimp portion 15 and the tool engagement portion 9; and the upper die 32 is pressed axially. At this time, a rear end portion of the metallic shell 2 is curved inward, thereby forming the crimp portion 15 and thus fixing the metallic shell 2 and the insulator 3 to each other. The curvature portion 10 is formed through radial bending deformation under a load imposed on the metallic shell 2. By virtue of the deformation; i.e., buckling, the crimp portion 15 strongly presses the projecting insulation portion 11 of the insulator 3 axially frontward via the seal members 14*a* and 14*b* and the seal filler 13. As a result, the stepped portion 20 of the insulator 3 presses the shoulder 18 of the metallic shell 2 via the packing member 19, whereby the shoulder 18 of the metallic shell 2, the stepped portion 20 of the insulator 3, and the packing member 19 are brought into close contact with each other. By this procedure, gas-tightness of the junction between the metallic shell 2 and the insulator 3 is ensured.

Figure 3:
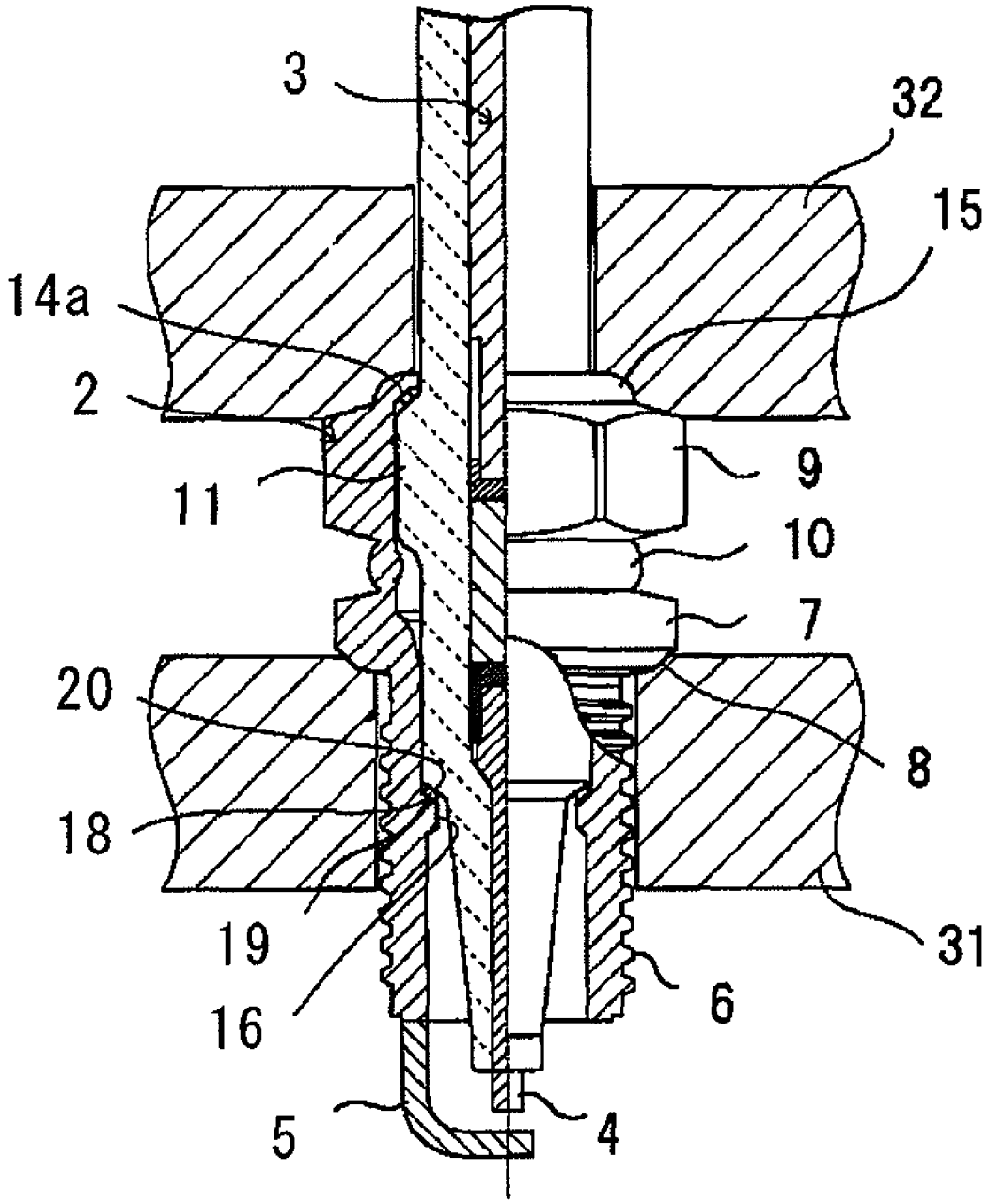
FIG. 3 is a schematic, sectional, explanatory view showing an example process of hot crimping as applied to the spark plug according to the present invention.

FIG. 3 is a schematic, sectional, explanatory view showing an example process of hot crimping as applied to the spark plug according to the present invention. The spark plug of the present embodiment does not have an annular space which is filled with a seal filler, such as talc. In the spark plug which does not employ a seal filler, such as talc, the projecting insulation portion 11 of the insulator 3 is axially elongated such that the rear end of the projecting insulation portion 11 is in direct contact with the crimp portion 15 of the metallic shell 2. The seal member 14*a* may be provided between the projecting insulation portion 11 and the crimp portion 15. Similar to the above-described case of cold crimping, the metallic shell 2 is held between the upper die 32 and the lower die 31 and is subjected to an axial load. While the load is applied, current is applied between the upper die 32 and the lower die 31. Current flows from the upper die 32 to the lower die 31 via the tool engagement portion 9, the curvature portion 10, and the trunk portion 7 of the metallic shell 2. At this time, since the curvature portion 10 is the most thin-walled and thus has a higher resistance, the curvature portion 10 is heated red. Accordingly, since the curvature portion 10 is softened, the load required for buckling of the curvature portion 10 can be lowered as compared with the case of cold crimping. Further, since the heated curvature portion 10 axially shrinks in association with cooling after completing the crimping process, intimate contact between the ledge 18 of the metallic shell 2, the stepped portion 20 of the insulator 3, and the packing member 19 is further improved, thereby enhancing gas-tightness of the spark plug.

The cold crimping of a spark plug having an annular space which is filled with a seal filler, such as talc, has been described with reference to FIG. 2. The hot crimping of a spark plug not having an annular space has been described with reference to FIG. 3. However, a spark plug having an annular space as shown in FIG. 2 may be formed through hot crimping. Among these spark plugs, the spark plug in which the annular space 12 is filled with the seal filler 13, such as talc, is preferred. Filling the annular space 12 with the seal filler 13, such as talc, further enhances gas-tightness of the junction between the metallic shell 2 and the insulator 3.

Next described is a feature of the spark plug according to the present invention; specifically, the ratio between the projected area of the taper portion and the projected area of the step portion of the metallic shell.

Figure 4:
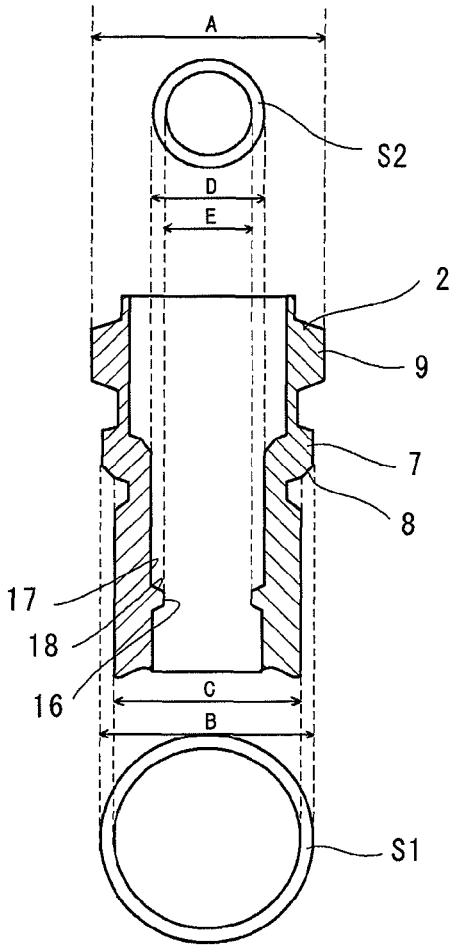
FIG. 4 is an enlarged, schematic, sectional, explanatory view showing a portion of the metallic shell that is to be crimped of the spark plug according to the present invention.

FIG. 4 is an enlarged, schematic, sectional, explanatory view showing a portion to be crimped of the metallic shell of the spark plug according to the present invention. The outside diameter of the tool engagement portion 9 is represented by A, the outside diameter of the trunk portion 7 is represented by B, the minimal outside diameter of the taper portion 8 to come into contact with a peripheral region around a mounting hole of an unillustrated internal combustion engine is represented by C, the inside diameter of the internal trunk portion 17 is represented by D, and the inside diameter of the step portion 16 is represented by E. When the insulator 3 and the metallic shell 2 are fixed to each other by cold crimping, a projected area $S_1$ of the taper portion 8 is at least two times a projected area $S_2$ of the step portion 16.

The projected area $S_1$ and the projected area $S_2$ are described as follows. The projected area $S_1$ of the taper portion 8 is the difference between the area of a region surrounded by the outline of the trunk portion 7 projected along the axis on an imaginary plane orthogonal to the axis and the area of a region surrounded by the outline of the taper portion 8 at its minimal outside diameter projected along the axis on the imaginary plane. The projected area $S_2$ of the step portion 16 is the difference between the area of a region surrounded by the outline of the internal trunk portion 17 projected along the axis on the imaginary plane and the area of a region surrounded by the outline of the step portion 16 projected along the axis on the imaginary plane.

When the spark plug according to the present invention is formed such that the insulator 3 and the metallic shell 2 are fixed to each other by hot crimping, the projected area $S_1$ of the taper portion 8 is at least 1.5 times the projected area $S_2$ of the step portion 16.

By employing the above-mentioned ranges, even when a sufficient load for ensuring gas-tightness is applied in the course of the aforementioned crimping process, the taper portion 8 of the metallic shell 2 can be spared from becoming deformed. Accordingly, even after crimping is completed, the taper portion 8 of the metallic shell 2 is free from deformation. Therefore, a spark plug having excellent gas-tightness can be provided.

The upper limit of the projected area $S_1$ of the taper portion can be set as appropriate such that no practical problem occurs when the spark plug is put into use. Preferably, in order to implement a small-sized spark plug, the projected area $S_1$ of the taper portion is equal to or less than a projected area $(\pi(A/2)^2-\pi(C/2)^2)$ defined as the difference between the area of a region surrounded by the outline of the tool engagement portion 9 projected along the axis on the aforementioned imaginary plane and the area of a region surrounded by the outline of the taper portion 8 at its minimal outside diameter projected along the axis on the imaginary plane; i.e., the outside diameter B of the trunk portion is equal to or less than the outside diameter A of the tool engagement portion.

The projected area $S_1$ of the taper portion 8 is obtained as follows. Using a projector, a measurement is made from the axial direction to obtain the outside diameter B of the trunk portion 7 of the metallic shell 2 and the minimal outside diameter C of the taper portion 8 to come into contact with a peripheral region around a mounting hole of an unillustrated internal combustion engine; i.e., the diameter C of the frontward end of the taper portion. The measured values are substituted into Eq. (1) for calculation.

$$S_1=\pi(B/2)^2-\pi(C/2)^2 \quad (1)$$

The projected area $S_2$ of the step portion 16 is obtained as follows. The inside diameter D of the internal trunk portion 17 and the inside diameter E of the step portion 16 are measured using a pin gauge or micrometer. The measured values are substituted into Eq. (2) for calculation.

$$S_2=\pi(D/2)^2-\pi(E/2)^2 \quad (2)$$

Preferably, the projected area $S_2$ of the step portion 16 is 6 $mm^2$ to 18 $mm^2$ inclusive. In order to implement a small-sized spark plug, the projected area $S_2$ is preferably 18 $mm^2$ or less. As the size of a spark plug is reduced, the projected area $S_2$ of the step portion 16, together with the projected area of the taper portion 8, is also reduced. At this time, since the size of the packing member 19 provided between the ledge 18 and the stepped portion 20 is also reduced, the projected area $S_2$ of the step portion 16 is preferably at least 6 $mm^2$ in order to maintain formability, etc., in the course of mass production of the packing member 19.

Figure 5:
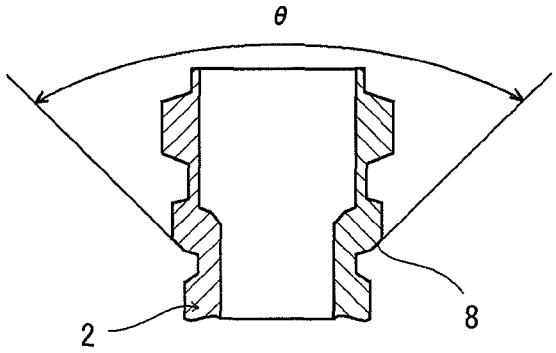
FIG. 5 is a schematic, sectional, explanatory view illustrating the taper angle of a taper portion of the outer surface of the metallic shell of the spark plug according to the present invention.

Preferably, the taper angle θ of the taper portion 8 is 50° to 120° inclusive. As shown in FIG. 5, the taper angle θ is an angle formed by two generatrices as viewed on the axial section of the taper portion 8. When the taper angle θ is 50° or greater, as shown in FIGS. 2 and 3, a load can be efficiently imposed on the packing member 19 provided between the shoulder 18 of the metallic shell 2 and the stepped portion 20 of the insulator 3 in the course of crimping. Thus, a taper angle θ of 50° or greater is preferred in view of ensuring of gas-tightness of the junction between the metallic shell 2 and the insulator 3. When the taper angle θ is 120° or less, gas-tightness of the junction between a spark plug and the cylinder head of an unillustrated internal combustion engine can be sufficiently ensured when the spark plug is mounted into a mounting hole of the cylinder head. Thus, a taper angle θ of 120° or less is preferred. The taper angle θ of the taper portion 8 can be measured using a projector.

Figure 6:
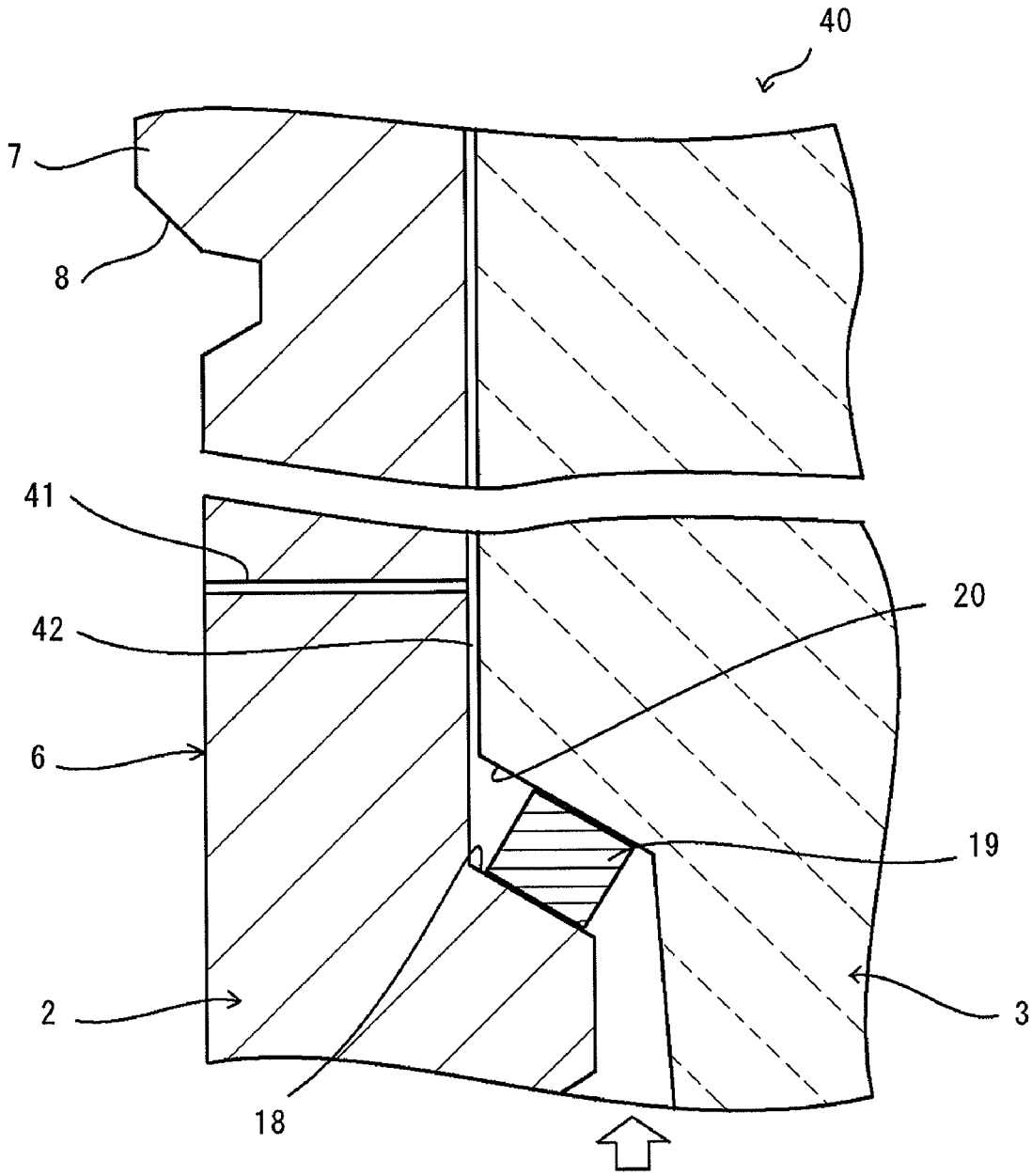
FIG. 6 is a schematic, sectional, explanatory view illustrating a test for evaluating gas tightness of a spark plug.

Gas-tightness of the junction between the metallic shell 2 and the insulator 3 can be evaluated by carrying out the gas-tightness test described below. FIG. 6 is a schematic, sectional, explanatory view illustrating the gas-tightness test. First, as shown in FIG. 6, a hole 41 is formed in the threaded portion 6 of the metallic shell 2 of a spark plug so as to extend through the metallic shell 2 from the outer surface of the threaded portion 6. This spark plug is taken as a spark plug test piece 40. The spark plug test piece 40 is such that, when gas is present in a gap 42 between the inner surface of the metallic shell 2 and the outer surface of the insulator 3, the gas can be released to the outside through the hole 41.

Next, a tube (not shown) is attached to the hole 41 formed in the threaded portion 6 of the spark plug test piece 40. While the distal end of the tube is submerged in water, air is supplied under a pressure of 1.5 MPa to the spark plug test piece 40 from the front end of the spark plug test piece 40. When gas-tightness of the junction between the metallic shell 2 and the insulator 3 is not sufficiently secured, air is released into the water through the gap 42 and the tube attached to the hole 41. Since the distal end of the tube is located within the water, even a slight leakage of gas can be detected. The temperature of the taper portion 8 of the metallic shell 2 is adjusted to 200° C.

Deformation of the taper portion 8 of the metallic shell 2 can be evaluated from a dimensional change in the outside diameter B of the trunk portion 7 measured using a projector before and after cold crimping or hot crimping.

The spark plug of the present invention is not limited to the above-described embodiments, but may be modified in various other forms, so long as the object of the present invention can be achieved. For example, in the spark plug 1, the front end surface of the center electrode 4 and the surface of one end of the ground electrode 5 face each other in the axial direction of the center electrode 4 with a spark gap defined therebetween. However, in the present invention, the side surface of the center electrode and the distal end surface of the ground electrode may face each other in a radial direction of the center electrode with a spark gap defined therebetween. In this case, one or more ground electrodes may face the side surface of the center electrode.

In the spark plug 1, the tool engagement portion 9 has a cross-sectional shape of a hexagon (HEX), but alternatively may have a cross-sectional shape of an icositetragon (Bi-HEX).

The spark plug of the present invention is adapted for use in an internal combustion engine of automobile and is fixedly inserted into each of mounting holes provided in an engine head (not shown) whose interior is divided into combustion chambers of an engine.

Example

Fabrication of Spark Plug Test Pieces

A plurality of metallic shells were fabricated which differed in ratio between the projected area of the taper portion and the projected area of the step portion. The insulator to which the center electrode was attached was fitted into each of the metallic shells, followed by crimping under a predetermined crimping load using a cold or hot crimping process. Spark plug test pieces were thus fabricated having a shape similar to that shown in FIG. 1. The spark plug test pieces were measured, using a projector, to obtain the outside diameter A of the tool engagement portion, the outside diameter B of the trunk portion, and the minimal outside diameter C of the taper portion to come into contact with a peripheral region around a mounting hole of an internal combustion engine. Also, the spark plug test pieces were measured to obtain the inside diameter D of the internal trunk portion and the inside diameter E of the step portion using a pin gauge and a micrometer. Measurement with the pin gauge and measurement with the micrometer yielded the same measured values. The projected area $S_1$ of the taper portion and the projected area $S_2$ of the step portion were calculated by substituting the measured values into the following equations.

$$S_1=\pi(B/2)^2-\pi(C/2)^2 \quad (1)$$

$$S_2=\pi(D/2)^2-\pi(E/2)^2 \quad (2)$$

The threaded portion of the fabricated spark plug test pieces had an outside diameter of 12 mm and a taper portion having a taper angle of 60°. In the spark plug test pieces which had undergone cold crimping, the space between the metallic shell and the insulator was filled with talc. In the spark plug test pieces which had undergone hot crimping, the space between the metallic shell and the insulator was not filled with talc.

Gas-Tightness Test

Before and after the crimping process, the outside diameter B of the trunk portion was measured. The gas-tightness test was carried out on the spark plug test pieces which were crimped under such a maximal crimping load that a dimensional change in the outside diameter B of the trunk portion was 0.1 mm or less.

The gas-tightness test was carried out as follows.

First, as shown in FIG. 6, the hole 41 was formed in the threaded portion 6 of the metallic shell 2 of each of the spark plug test pieces 40 so as to extend through the metallic shell 2 from the outer surface of the threaded portion 6, thereby releasing gas, if any, in the gap 42 between the inner surface of the metallic shell 2 and the outer surface of the insulator 3, through the hole 41.

Next, a tube was attached to the hole 41 formed in the threaded portion 6 of each of the spark plug test pieces 40. While the distal end of the tube was submerged in water, air was supplied under a pressure of 1.5 MPa to the spark plug test piece 40 from the front end of the spark plug test piece 40. At this time, an observation was made as to whether or not air was released into the water through the gap 42 and the tube attached to the hole 41. The temperature of the taper portion 8 of the metallic shell 2 was measured and adjusted to 200° C.

Table 1 shows the test results of the spark plug test pieces fabricated through cold crimping. Table 2 shows the test results of the spark plug test pieces fabricated by hot crimping. The test result was marked "a" when the release of air was not observed, and was marked "b" when the release of air was observed.

Notably, in Examples 7, 8, 28 and 29, the outside diameter B of the trunk portion was greater than the outside diameter A of the tool engagement portion.

As shown in Table 1, the spark plug test pieces fabricated by cold crimping were free from the release of air when the ratio of the projected area $S_1$ of the taper portion to the projected area $S_2$ of the step portion was 2.0 or higher. Thus, the metallic shell and the insulator of these test pieces are considered to be sufficiently gas-tight against each other. Therefore, when the ratio of the projected area $S_1$ of the taper portion to the projected area $S_2$ of the step portion falls within the aforementioned range, even a small-sized spark plug having a threaded portion having an outside diameter of 12 mm can be cold-crimped so as to ensure sufficient gas-tightness of the junction between the metallic shell and the insulator by preventing deformation of the taper portion.

As shown in Table 2, the spark plug test pieces fabricated by hot crimping were free from the release of air when the ratio of the projected area $S_1$ of the taper portion to the projected area $S_2$ of the step portion was 1.5 or higher. Thus, the metallic shell and the insulator of these test pieces are considered to be sufficiently gas-tight against each other. Therefore, when the ratio of the projected area $S_1$ of the taper portion to the projected area $S_2$ of the step portion falls within the aforementioned range, even a small-sized spark plug having a threaded portion have an outside diameter of 12 mm can be hot-crimped so as to ensure sufficient gas-tightness of the junction between the metallic shell and the insulator by preventing deformation of the taper portion.

TABLE 1

| Sample No. | Projected area $S_1$ of taper portion ($mm^2$) | Projected area $S_2$ of step portion ($mm^2$) | $S_1/S_2$ | Result |
|---|---|---|---|---|
| Comp. Ex. 1 | 16.0 | 13.5 | 1.2 | b |
| Comp. Ex. 2 | 20.0 | 13.5 | 1.5 | b |
| Comp. Ex. 3 | 25.0 | 13.5 | 1.9 | b |
| Example 1 | 27.0 | 13.5 | 2.0 | a |
| Example 2 | 30.0 | 13.5 | 2.2 | a |
| Example 3 | 35.0 | 13.5 | 2.6 | a |
| Example 4 | 40.0 | 13.5 | 3.0 | a |
| Example 5 | 50.0 | 13.5 | 3.7 | a |
| Example 6 | 60.0 | 13.5 | 4.4 | a |
| Example 7 | 65.0 | 13.5 | 4.8 | a |
| Example 8 | 70.0 | 13.5 | 5.2 | a |

TABLE 2

| Sample No. | Projected area $S_1$ of taper portion ($mm^2$) | Projected area $S_2$ of step portion ($mm^2$) | $S_1/S_2$ | Result |
|---|---|---|---|---|
| Comp. Ex. 21 | 16.0 | 13.5 | 1.2 | b |
| Comp. Ex. 22 | 19.0 | 13.5 | 1.4 | b |
| Example 21 | 20.0 | 13.5 | 1.5 | a |
| Example 22 | 25.0 | 13.5 | 1.9 | a |
| Example 23 | 27.0 | 13.5 | 2.0 | a |
| Example 24 | 30.0 | 13.5 | 2.2 | a |
| Example 25 | 40.0 | 13.5 | 3.0 | a |
| Example 26 | 50.0 | 13.5 | 3.7 | a |
| Example 27 | 60.0 | 13.5 | 4.4 | a |
| Example 28 | 65.0 | 13.5 | 4.8 | a |
| Example 29 | 70.0 | 13.5 | 5.2 | a |

It should further be apparent to those skilled in the art that the various changes in form and detail of the invention as shown and described above may be made. It is intended that such changes be included within the spirit and scope of the claims appended hereto.

This application claims priority from Japanese Patent Application No. 2008-310544 filed Dec. 5, 2008, incorporated herein by reference in its entirety.

What is claimed is:

1. A spark plug comprising:

a center electrode extending in an axial direction;

an insulator which holds an outer circumference of the center electrode;

a metallic shell which holds an outer circumference of the insulator; and a ground electrode joined to a front end portion of the metallic shell and forming a gap in cooperation with the center electrode;

wherein the metallic shell has an outer surface having:

a taper portion which comes into contact with a peripheral region around a mounting hole of an internal combustion engine when the spark plug is mounted in the mounting hole;

a tool engagement portion with which a tool is engaged when mounting the spark plug into the mounting hole; and a trunk portion formed between the tool engagement portion and the taper portion, and an inner surface having:

an annular step portion projecting toward the insulator and an internal trunk portion extending from a base of the step portion toward a rear end of the metallic shell, wherein an outside diameter of the trunk portion is represented by B, a minimal outside diameter of the taper portion is represented by C, an inside diameter of the internal trunk portion is represented by D, and an inside diameter of the step portion is represented by E, the insulator and the metallic shell are fixed to each other by cold crimping, and a projected area ($\pi(B/2)^2-\pi(C/2)^2$) of the taper portion, defined as a difference between an area of a region surrounded by an outline of the trunk portion projected on an imaginary plane orthogonal to the axis and an area of a region surrounded by an outline of the taper portion at its minimal outside diameter projected on the imaginary plane, is at least two times a projected area ($\pi(D/2)^2-\pi(E/2)^2$) of the step portion defined as a difference between an area of a region surrounded by an outline of the internal trunk portion projected on the imaginary plane and an area of a region surrounded by an outline of the step portion projected on the imaginary plane.

2. The spark plug according to claim 1, wherein the outer surface of the metallic shell has a threaded portion for mounting the spark plug into the mounting hole of the internal combustion engine, said threaded portion having an outside diameter of 12 mm or less.

3. The spark plug according to claim 1, wherein the projected area of the step portion is 6 $mm^2$ to 18 $mm^2$ inclusive.

4. The spark plug according to claim 1, wherein the taper portion has a taper angle θ of 50° to 120° inclusive.

5. The spark plug according to claim 1, further comprising a seal filler including talc provided between the inner surface of the metallic shell opposite the tool engagement portion and an outer surface of the insulator.

6. A spark plug comprising:

a center electrode extending in an axial direction;

an insulator which holds an outer circumference of the center electrode;

a metallic shell which holds an outer circumference of the insulator; and a ground electrode joined to a front end portion of the metallic shell and forming a gap in cooperation with the center electrode;

wherein the metallic shell has an outer surface having:

a taper portion which comes into contact with a peripheral region around a mounting hole of an internal combustion engine when the spark plug is mounted in the mounting hole;

a tool engagement portion with which a tool is engaged when mounting the spark plug into the mounting hole; and a trunk portion formed between the tool engagement portion and the taper portion, and an inner surface having:

an annular step portion projecting toward the insulator and an internal trunk portion extending from a base of the step portion toward a rear end of the metallic shell, wherein an outside diameter of the trunk portion is represented by B, a minimal outside diameter of the taper portion is represented by C, an inside diameter of the internal trunk portion is represented by D, and an inside diameter of the step portion is represented by E, the insulator and the metallic shell are fixed to each other by hot crimping, and a projected area $(\pi(B/2)^2-\pi(C/2)^2)$ of the taper portion, defined as a difference between an area of a region surrounded by an outline of the trunk portion projected on an imaginary plane orthogonal to the axis and an area of a region surrounded by an outline of the taper portion at its minimal outside diameter projected on the imaginary plane, is at least 1.5 times a projected area $(\pi(D/2)^2-\pi(E/2)^2)$ of the step portion defined as a difference between an area of a region surrounded by an outline of the internal trunk portion projected on the imaginary plane and an area of a region surrounded by an outline of the step portion projected on the imaginary plane.

7. The spark plug according to claim 6, wherein the outer surface of the metallic shell has a threaded portion for mounting the spark plug into the mounting hole of the internal combustion engine, said threaded portion having an outside diameter of 12 mm or less.

8. The spark plug according to claim 6, wherein the projected area of the step portion is 6 $mm^2$ to 18 $mm^2$ inclusive.

9. The spark plug according to claim 6, wherein the taper portion has a taper angle θ of 50° to 120° inclusive.

10. The spark plug according to claim 6, further comprising a seal filler including talc provided between the inner surface of the metallic shell opposite the tool engagement portion and an outer surface of the insulator.

* * * * *